US005377611A

United States Patent [19]

Crookham et al.

[11] Patent Number: 5,377,611

[45] Date of Patent: Jan. 3, 1995

[54] MEANS AND METHOD FOR CHARITABLE DONATION PROMOTION

[75] Inventors: Joe P. Crookham; Jeffrey A. Rogers, both of Oskaloosa, Iowa

[73] Assignee: Musco Corporation, Oskaloosa, Iowa

[21] Appl. No.: 992,840

[22] Filed: Dec. 18, 1992

[51] Int. Cl.[6] ..... G09F 17/00

[52] U.S. Cl. ..... 116/173

[58] Field of Search ..... 116/173; 40/124.5; 248/218.4, 219.3, 230, 534, 540, 541; 362/249, 431

[56] References Cited

U.S. PATENT DOCUMENTS

| | | | |
|---|---|---|---|
| 1,223,487 | 4/1917 | Gohl | 248/540 X |
| 1,383,234 | 6/1921 | Raguse | 116/173 |
| 1,551,719 | 9/1925 | Williams | 248/230 X |
| 1,788,157 | 1/1931 | Hogan | 248/230 |
| 2,278,287 | 3/1942 | Ryan | 116/173 |
| 2,882,630 | 4/1959 | Frey | 116/173 |
| 3,080,139 | 3/1963 | Caprioli | 116/173 |
| 3,564,743 | 2/1971 | Gilmoure | 248/230 X |
| 3,977,110 | 8/1976 | Yerger | 40/124.5 |
| 5,274,534 | 12/1993 | Armstrong | 362/249 |

FOREIGN PATENT DOCUMENTS

| | | | |
|---|---|---|---|
| 1448181 | 6/1966 | France | 362/431 |

*Primary Examiner*—William A. Cuchlinski, Jr.
*Assistant Examiner*—Willie Morris Worth
*Attorney, Agent, or Firm*—Zarley, McKee, Thomte, Voorhees & Sease

[57] ABSTRACT

A device and method for visually displaying information relative to donations with respect to a promotional event includes flags and a display board that can be viewed from relatively close up. One or more flags are displayed in close proximity to the display board and have indicia relevant to the promotional event or donations. The flags can be visually observed from relatively close up and from relatively far away.

14 Claims, 1 Drawing Sheet

MEANS AND METHOD FOR CHARITABLE DONATION PROMOTION

BACKGROUND OF THE INVENTION

A. Field of the Invention

The present invention relates to a means and method for providing a visual indication of charitable contributions for promoting the same.

B. Problems in the Art

The funding for many worthwhile projects consists of obtaining donations from individuals and businesses. It generally has been found that a certain amount of promotion of the project or clause results in a higher level of donations.

A variety of promotional activities are commonly known. Samples are fund raising dinners, door-to-door solicitations, mailings, advertising, and alike.

One type of promotional activity commonly utilized in raising funds involves the placement of placards on items purchased with donated money. For example, an individual who donates money to a park may be recognized by attaching a placard on or near a park bench identifying the generous individual.

Another type of promotional activity involves some sort of a visual display either showing the magnitude of donations and/or acknowledging the identity of the donators.

There is room for improvement in this field. The aforementioned promotional activities may be effective for only limited circumstances. They also may not be as visually prominent as might be beneficial.

For example, a placard placed on a park bench is only effective for those in close proximity with the placard. Generally, however, there is seldom a need to be in close proximity with a flag or light pole, especially one located at a sports complex. There is a need in the art for recognizing contributors in a manner visually perceptible at a distance.

Additionally, a placard placed on a bench is a permanent measure. Certain donation schemes require a more temporary method of recognition. For example, if an individual donates funds for the lighting of an athletic field for a month, a temporary means for identifying the donator is not available in the art.

A method of recognizing donations in a competitive manner is also absent in the field. For example, when raising money for little league uniforms, the league could designate one light pole to be associated with each team and flags could be added to the pole as each team approached their goal. In this manner, each team is recognized, each donator is acknowledged, and competition fosters increased donations.

Finally, there is no method or apparatus in the art which effectively allows a fund-raiser to both recognize individuals (placard on a park bench) and display progression towards a goal.

It is therefore a primary object of the present invention to improve over the state of the art regarding a Means and Method For Charitable Donation Promotion.

A further object of the present invention is to provide a means and method as above-described which consists of a highly unique visual indicator.

Another object of the present invention is to provide a means and method as above-described which has flexibility in its use and application.

A still further object of the present invention is to provide a means and method for charitable donation promotion which can be temporary in nature.

Another object of the present invention is to provide a means and method as above-described which fosters competition between fund-raising subgroups.

An additional object of the present invention is to provide a means and method as above-described which operates as a two-stage system, recognizing individuals and groups that donate funds or time while simultaneously displaying a progression towards a goal.

A further object of the present invention is to provide a means and method as above-described which is economical, efficient, and durable.

These and other objects, features, and advantages of the present invention will become more apparent with reference to the accompanying specification and claims.

SUMMARY OF THE INVENTION

The present invention relates to a means and method for visually indicating a promotional activity. It consists of a display board means where acknowledgment of donors can be listed for visual review by an observer that is relatively close by board means. It includes, in combination, also one or more flags or banner means connected to pole means which can be positioned at or near the display board. The flag means can bear various indicia, for example, donors' names that can be read by observers that are farther away than can read the board means. Other indicia can be included on the flags, including ones comprising various colors corresponding to certain meanings.

Further, the means and method can relate to displaying a plurality of flags, related to some fact relevant to the promotional scheme, for example the number of donors, the quantity of donations, etc.

The invention therefore combines the board means, having readable information regarding the promotional event, donors, or other matters, in combination with flag means which perceivable from a longer distance and can have meanings and correlations related to the promotional event.

DETAILED DESCRIPTION OF THE DRAWINGS

DETAILED DESCRIPTION OF THE PREFERRED EMBODIMENT

Figure 1:
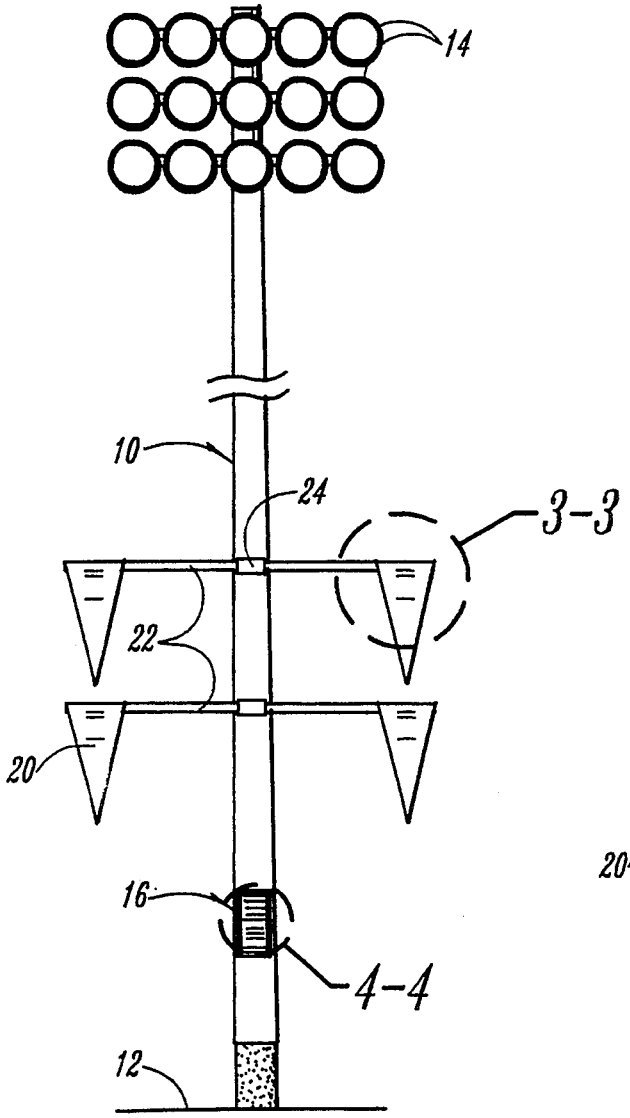
FIG. 1 is a perspective view of a preferred embodiment of the present invention.

To assist in a better understanding of the invention, a preferred embodiment of the invention will now be described in detail. Reference will be taken to the accompanying drawings in this description. Reference numerals will be used to indicate certain parts and locations in the drawings. The same reference numerals will be used to indicate the same parts and locations throughout the drawings, unless otherwise indicated.

FIG. 1 shows a pole 10 installed in ground 12. A plurality of light fixtures 14 are secured to the top of the pole 10. The environment for such a pole 10 could be at an athletic field such as a little league baseball field, where the lights 14 are used to illuminate the baseball field for playability in low level or after sunset conditions.

A display board or plaque 16 is positioned near the bottom of pole 10 at a height generally readable by persons standing on the ground 12. Plaque 16 bears indicia 18. In the preferred embodiment this could include a short description of the promotional event (for example, finding of lighting for the little league field), and a list of donors towards an ultimate goal for paying off the lighting.

FIG. 1 also shows that additionally a plurality of flags 20, attached at outer ends of flag poles 22, are also attached to pole 10. A means for attachment 24 demountably secures the flag poles 22 to the pole 10.

Figure 3:
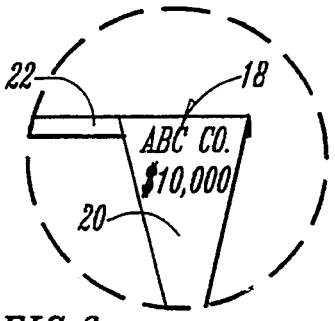
FIG. 3 is an enlarged view taken along line 3—3 of FIG. 1.

FIG. 3 shows in enlarged detail one of flags 20 of FIG. 1. Flag 20 includes indicia 18 which could include such things as the names of individual donors and their donation amounts. Flags can also be of different colors to show different levels of donation.

Figure 2:
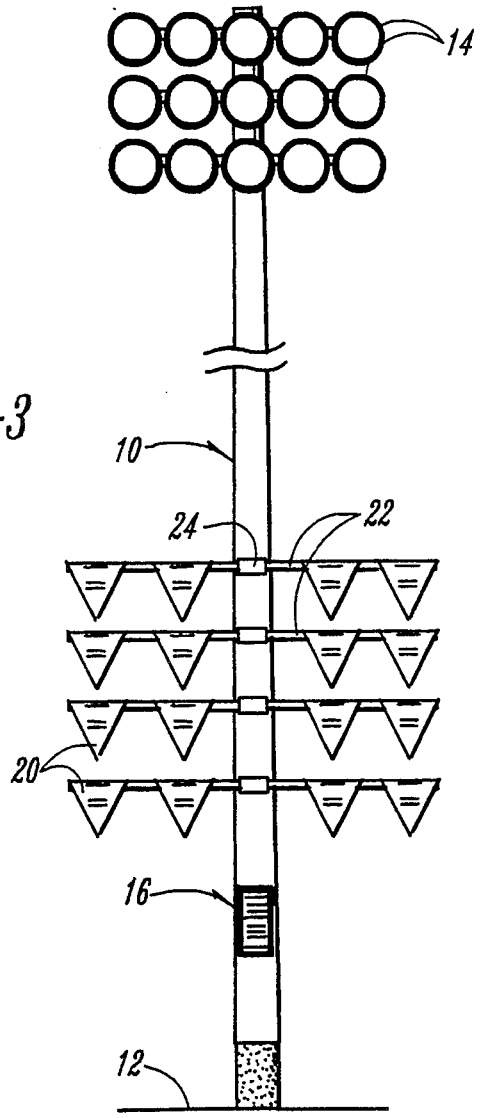
FIG. 2 is similar to FIG. 1 but shows variation or alternative embodiment according to the present invention.
Figure 4:
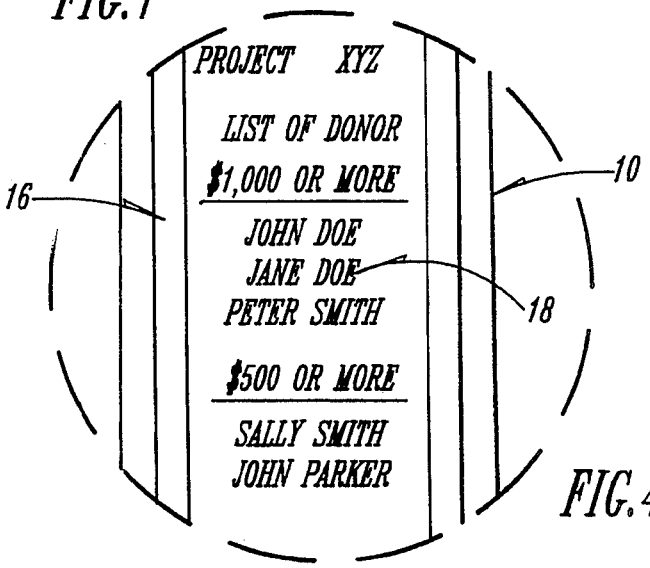
FIG. 4 is an enlarged view taken along line 4—4 of FIG. 1.

FIG. 2 shows the same type of combination as FIG. 1, but with several more flag means 20.

The combination according to the preferred embodiment of the present invention therefore can function as follows. If lights for a little league field are purchased and installed upon the premise that a funding drive for donations will follow, display board 16 can be attached to a pole that can be viewed from close up by people. As the promotional event continues to obtain funding, names can be added to the display board 16. Similarly, names and flags 20 can be added and elevated to provide visual indication of the progress of the promotional event for persons a longer distance away from pole 10.

As shown in FIG. 2, flags can be placed sequentially in an effort to illustrate for a large number of people or from distances far away how close to an ultimate goal for the funding the promotion has achieved.

It is to be understood that this description of a preferred embodiment according to the invention is but one form the invention can take and is not by way of limitation. The scope of the invention is defined by the appended claims. Other embodiments are possible.

For example, flags can be color coded regarding donation amount, or other factors relevant to the promotional event. Flags can be of different shapes and sizes. It is noted that the bottoms of flags 20 can be appropriately weighted or the flags 20 can be made of a rigid material so that they will deter flapping or wrapping around the flag poles 22.

Other mechanisms for raising and lowering the flags can be utilized. The display board can take on different configurations.

The included preferred embodiments are given by way of example only, and not by way of limitation to the invention, which is solely described by the claims herein. It will be appreciated that the invention can take many forms and embodiments.

The included preferred embodiments are given by way of example only, and not by way of limitation to the invention, which is solely described by the claims herein. It will be appreciated that the invention can take many forms and embodiments.

What is claimed is:

1. An apparatus for visual display of information relating to donations to one of a promotional and advertising goal comprising:

a pole fixed in the ground at a lower end and having an upper end extending generally vertically;

a bank of light fixtures fixed to the upper end of the pole which can issue controlled, concentrated beams of light to a target area away from the pole; and one or more flag devices fixed to the pole, each flag device bearing indicia related to a factor relevant to said one of the promotional and advertising goal, each flag device comprising an elongated bar having opposite ends and mounted generally horizontally to the pole by a mounting bracket, one or more flag members bearing the indicia and having proximal and distal ends, each flag member being attached to one of the bars at said proximal end, and said distal end hanging freely from said one of the bars, so that the flag member can swing and move relative to its fixed attachment at said proximal end; and so that the apparatus concurrently allows visual display of information relating to donations to one of the promotional and advertising goal and high intensity lighting to a target area for wide area lighting such as sports field lighting.

2. The apparatus of claim 1 comprising a plurality of flag devices, the number of flag devices being related to the one of the promotional and advertising goal.

3. A method of visually indicating donation activity related to one of a promotional event and advertising goal on one or more fixed in the ground vertical poles each having a bank of lights for providing lights to a target area away from the pole comprising:

displaying one or more flags mounted on a pole, each flag having indicia related to one of the promotional event and advertising goal by fixing one or more brackets to the pole, each bracket being fixed at a separate location between the bank of lights and the ground, mounting one generally horizontal bar to each bracket, each bar having opposite ends, and placing one or more flags on each bar, where the flags of each bar are fixed at one end to a location on the bar and hang freely downward from the bar.

4. The apparatus of claim 1 wherein the bank comprises a plurality of lighting fixtures, each fixture mounted to a crossarm connected to the pole.

5. The apparatus of claim 1 further comprising a plurality of poles, each having a bank of lights to light one or more target areas.

6. The apparatus of claim 1 wherein each mounting bracket fixes a corresponding bar to a single location along the pole.

7. The apparatus of claim 1 wherein one or more flag members is attached to a bar which is attached at a single location along the pole.

8. The apparatus of claim 7 wherein a plurality of flag members is attached to a bar along the pole, wherein the plurality of flag members comprises two flag members, each placed at opposite ends of the bar.

9. The apparatus of claim 7 wherein the bar contains a plurality of flag members spaced along the bar.

10. The apparatus of claim 1 further comprising a display mounted on the pole at an elevational height substantially related to viewing and reading by persons standing or sitting relatively near the pole, the display including indicia associated with the promotional or advertising goal.

11. The method of claim 3 further comprising placing one or more bars along a pole, the number of bars being related to the one of the promotional event and the advertising goal.

12. The method of claim 3 wherein the number of flags placed along one or more bars is related to the one of the promotional event and the advertising goal.

13. The method of claim 3 further comprising positioning a display which is readable by persons generally adjacent to the display by positioning the display on a pole at an elevational height substantially related to viewing and reading by persons standing or sitting relatively near the pole.

14. A method of claim 3 wherein the flags are positioned along the pole at an elevational height substantially higher than conventional human height.

* * * * *